US009380846B2

(12) United States Patent
Agarwal

(10) Patent No.: US 9,380,846 B2
(45) Date of Patent: Jul. 5, 2016

(54) EXPANDABLE LUGGAGE ITEM

(71) Applicant: Amity Luggage and Bags Limited, Wolverhampton (GB)

(72) Inventor: Udayan Agarwal, Essex (GB)

(73) Assignee: Amity Luggage and Bags Limited, Wolverhamptom (GB)

( * ) Notice: Subject to any disclaimer, the term of this patent is extended or adjusted under 35 U.S.C. 154(b) by 0 days.

(21) Appl. No.: 14/230,966

(22) Filed: Mar. 31, 2014

(65) Prior Publication Data

US 2015/0101902 A1 Apr. 16, 2015

(30) Foreign Application Priority Data

Oct. 10, 2013 (GB) ..... 1317958.5

(51) Int. Cl.

| | |
|---|---|
| ***A45C 13/00*** | (2006.01) |
| ***A45C 7/00*** | (2006.01) |
| ***A45C 5/14*** | (2006.01) |
| ***A45C 13/26*** | (2006.01) |

(52) U.S. Cl.

CPC ..... *A45C 7/0027* (2013.01); *A45C 5/14* (2013.01); *A45C 13/262* (2013.01); *A45C 2013/267* (2013.01)

(58) Field of Classification Search

CPC .... A45C 7/059; A45C 7/0068; A45C 7/0027; A45C 13/103; A45C 13/262

USPC ..... 190/103–105

See application file for complete search history.

(56) References Cited

U.S. PATENT DOCUMENTS

| | | | | |
|---|---|---|---|---|
| 2,030,360 | A * | 2/1936 | Dyer | 190/117 |
| 4,513,866 | A * | 4/1985 | Thomas | 206/570 |
| 4,773,515 | A * | 9/1988 | Kotkins, Jr. | 190/103 |
| 5,307,908 | A * | 5/1994 | Shyr et al. | 190/18 A |
| 5,472,082 | A * | 12/1995 | Thiele | 206/284 |
| 5,620,069 | A | 4/1997 | Hurwitz | |
| 7,874,409 | B1 | 1/2011 | Lakhal | |
| 9,038,679 | B2 * | 5/2015 | Marquez-Bottome | 150/103 |
| 2003/0042091 | A1 * | 3/2003 | Oh | 190/111 |
| 2004/0262111 | A1 * | 12/2004 | Ghiassi | 190/103 |
| 2005/0268622 | A1 | 12/2005 | Krieger | |

(Continued)

FOREIGN PATENT DOCUMENTS

| | | | |
|---|---|---|---|
| DE | 202007007390 | U1 | 8/2007 |
| FR | 2968172 | A1 | 6/2012 |

(Continued)

OTHER PUBLICATIONS

Extended European Search Report dated Mar. 16, 2015 for co-pending European Application No. 13190266.0-1653.

*Primary Examiner* — Sue A Weaver

(74) *Attorney, Agent, or Firm* — Dinsmore & Shohl LLP; Douglas L. Wathen

(57) ABSTRACT

This invention relates to an expandable item of luggage. This enables a luggage item to be expanded to accommodate an increased volume of luggage. The luggage item is defined by a base, front, back, side and top portion. The base and top portions are spaced in a longitudinal axis and define a storage zone therebetween. The luggage item further comprises an expansion arrangement configured to enable expansion of the top portion independently of the front portion in the longitudinal axis between a retracted and expanded configuration to cause an effective increase in the volume of the storage zone.

10 Claims, 7 Drawing Sheets

(56) References Cited

U.S. PATENT DOCUMENTS

| | | | | |
|---|---|---|---|---|
| 2006/0102673 | A1* | 5/2006 | Collier | 224/581 |
| 2007/0164064 | A1* | 7/2007 | Nathan | 224/153 |
| 2007/0295570 | A1* | 12/2007 | Campbell et al. | 190/15 R |
| 2008/0142322 | A1 | 6/2008 | Barker et al. | |
| 2013/0092490 | A1 | 4/2013 | Moon | |
| 2013/0175130 | A1* | 7/2013 | Liang | 190/18 A |
| 2015/0060221 | A1* | 3/2015 | Bourette | 190/18 A |

FOREIGN PATENT DOCUMENTS

| | | | |
|---|---|---|---|
| GB | 2462009 | A | 1/2010 |
| JP | 2011172771 | A | 9/2011 |
| WO | WO-9313687 | A1 | 7/1993 |
| WO | WO-2009041860 | A2 | 4/2009 |
| WO | WO-2010141207 | A1 | 12/2010 |
| WO | WO-2013072399 | A2 | 5/2013 |

* cited by examiner

EXPANDABLE LUGGAGE ITEM

This application claims priority to United Kingdom Application No. GB1317958.5, filed Oct. 10, 2013, the contents of which are incorporated herein in their entirety.

The present invention relates to an expandable item of luggage.

Items of luggage come in a wide range of sizes and shapes arranged for their intended purpose. Some luggage items include expandable portions provided in order that a user has flexibility when using their item of luggage for different purposes. Instead of a user purchasing different items of luggage they expand or contract the expandable portion of their luggage as appropriate depending on the volume or shape of the items to be carried.

Known types of expandable luggage include an expandable portion that expands in a plane parallel to the base. This effectively increases the surface area of the base thereby increasing the volume of the luggage that can be carried.

The present invention provides an improved luggage item capable of being expanded to accommodate an increased volume of luggage.

According to the present invention there is a luggage item defined by a base, front, back, side and top portions, the base and top portions being spaced in a longitudinal axis defining a storage zone therebetween, the luggage item further comprising an expansion arrangement configured to enable expansion of the top portion independently of the front portion in the longitudinal axis between a retracted and expanded configuration to cause an effective increase in the volume of the storage zone.

The presently claimed invention provides significant advantages over prior art and expandable luggage in general. A problem associated with expanding sideways or effectively increasing the area of the base is susceptibility of the arrangement enabling expansion to become damaged. Such an arrangement enabling expansion is often in contact with the ground and is susceptible to scuffing and catching on, example, luggage conveyers or luggage storage racks. Furthermore, the present invention enables the volume of the internal storage zone to be increased without causing a reduction in the capability to manoeuvre the luggage item around. For example, the luggage item can be manoeuvred around a busy transport terminal such as an airport without accidental and unintentional impact occurring with other travellers. Such a benefit is a result of the floor space occupied by the luggage not being increased.

The front portion is beneficially arranged to enable access to the storage zone. This may be achieved by a closure element such as a zip projecting adjacent three peripheral edges of the front portion such that opening of the closure element(s) enables a section of the front portion to be pivoted about the fourth peripheral edge thus enabling access to the storage zone. The expansion arrangement configured to enable expansion of the top portion independently of the front means that a closure element such as a zip is unimpeded by expansion of the top portion, and access is enabled whether the top portion is retracted or expanded.

It is further noted that airlines typically have luggage size restrictions. The presently claimed invention provides a benefit as in the retracted configuration it can be configured to comply with luggage size restrictions. When departing for example from an aeroplane the luggage can be expanded to accommodate other items that a passenger typically carries such as a water bottle, item of clothing or book for example. These can be conveniently stored within the expanding portion of the luggage whilst still retaining the manoeuvrability of the luggage associated with expansion upwardly rather than through expansion of the foot area or surface of the area base, and without fear of causing damage to the expansion arrangement.

The expansion arrangement beneficially includes a closure element for retaining the luggage item in the retracted configuration. The expansion arrangement may include an extension section capable of extending the longitudinal axis. The extension section beneficially comprises a flexible and foldable material. The extension section is beneficially secured at or adjacent a peripheral edge of the side, front and back portions. The extension section beneficially includes its own front, back and side extension portions, where the front, back and side extension portions are expandable.

The front, back and side extension portions each beneficially extend linearly in the longitudinal axis in the expanded configuration.

The closure element beneficially retains the front, back and side extension portions in a folded and retracted configuration.

The closure element preferably comprises a zip extending around at least one of a portion of the front, back and side portions.

A handle arrangement is beneficially provided including a handle and a shaft, the shaft arranged for securing the handle to the luggage item, wherein the shaft is extendable in the longitudinal axis. The shaft beneficially extends through the top portion. The top portion of the luggage item preferably includes an access portion to enable passage of the shaft and preferably the handle through the top portion. The access portion preferably comprises a flap. The flap may be secured by a closure element.

A supplementary or alternative feature may be the provision of one or more straps for carrying the luggage item. There are preferably at least two straps, each of a first and second strap being arranged to be passed over a wearer's shoulder and such that the luggage item is carried as a backpack. The one or more straps preferably extend longitudinally and are preferably secured adjacent the intersection of the back portion and base portion and adjacent the intersection of the top portion and back portion. The one or more straps are preferably, however, secured to the back portion.

The front and back portions are preferably substantially parallel, and the opposing side portions are preferably substantially parallel. Such a configuration optimises the volume of the storage zone and maximises packing capability of multiple luggage items.

The cross sectional area of the base preferably remains constant in both the expanded and retracted configuration.

One or more wheels are beneficially provided positioned to enable movement of the item of luggage across a surface. In combination with the handle arrangement the wheels enable the luggage items to be effectively dragged. The luggage item is beneficially a trolley.

It is beneficial that the luggage item further comprises a second expansion arrangement configured to enable expansion of the volume of the storage zone in a second axis substantially perpendicular to the longitudinal axis. Furthermore, a third expansion arrangement may be provided configured to enable expansion of the volume of the storage zone in a third axis substantially perpendicular to the second axis. The second expansion arrangement is beneficially configured to enable expansion of the storage zone from a side portion of the luggage item. It is further beneficial that expansion of the second expansion arrangement is spaced apart in the longitudinal axis from the base portion. This provides a significant advantage in that the second expansion arrangement does not impinge or interfere with movement of the luggage item over the ground. In other words, the second expansion arrangement is effectively offset longitudinally from the base portion meaning that the second expansion arrangement does not catch on a floor which is susceptible to damage when in use. The second expansion arrangement is therefore protected to some extent but retains the ability for the luggage item to expand from a side portion.

The third expansion arrangement is beneficially configured to enable expansion of the volume of the storage zone from the front portion of the luggage item. This provides a further increase in the volume of the storage zone in three axes and is therefore adaptable to an individual traveller's needs.

It will be appreciated that the expansion arrangement may include a zip in the secured configuration arranged to retain a folded material. In another embodiment the zip could be replaced by one or more straps. Alternative arrangements for an expansion arrangement will be readily appreciated by the skilled addressee.

The present invention will now be described by way of example only with reference to accompanying drawings in which:

FIG. 1 is a schematic perspective view of an apparatus according to an exemplary embodiment of the present invention.

FIG. 2*a* and FIG. 2*b* are back views of the luggage item showing in FIG. 2*a*, the luggage item in the retracted or non-expanded configuration, and in FIG. 2*b* the luggage item is shown in the expanded configuration according to an exemplary embodiment of the present invention. FIGS. 2*c, d*, and *e* show an additional feature wherein access is enabled to the storage zone through the top portion according to a further exemplary embodiment of the present invention.

Figure 8A:
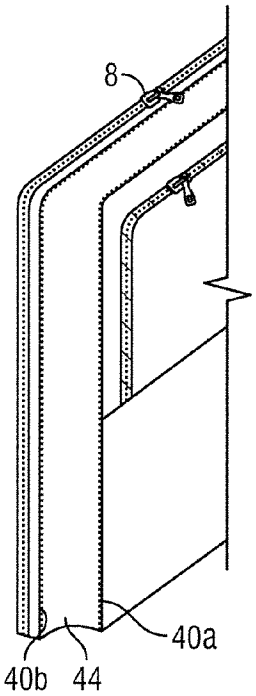
Figure 8B:
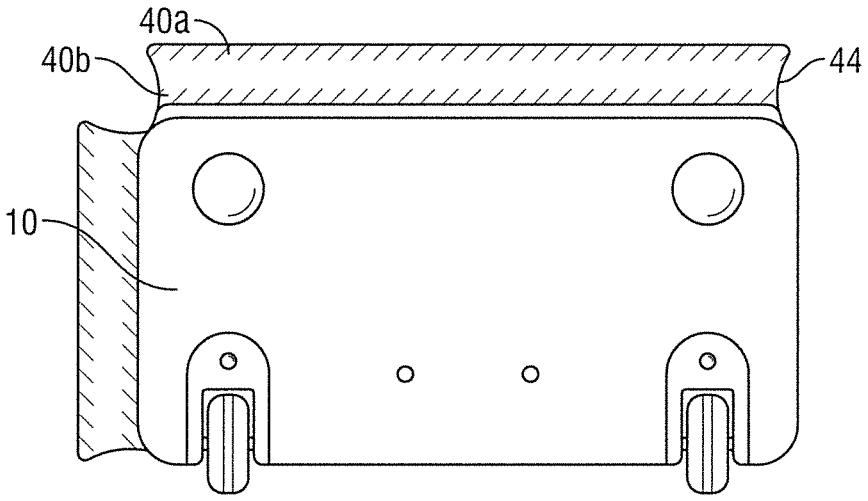

FIG. 8*a* and FIG. 8*b* are schematic views of a portion of the front perspective and base respectively of an exemplary embodiment of the present invention.

Figure 9:
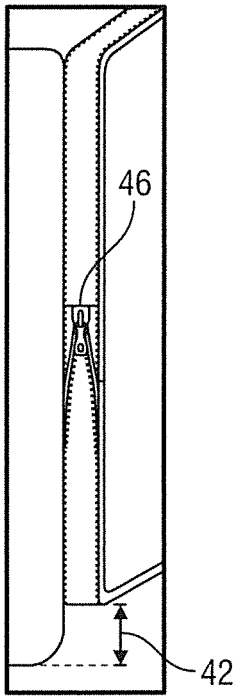

FIG. 9 is a schematic perspective view showing the back and side of a luggage item according to an exemplary embodiment of the present invention.

Figures 1, 2A:
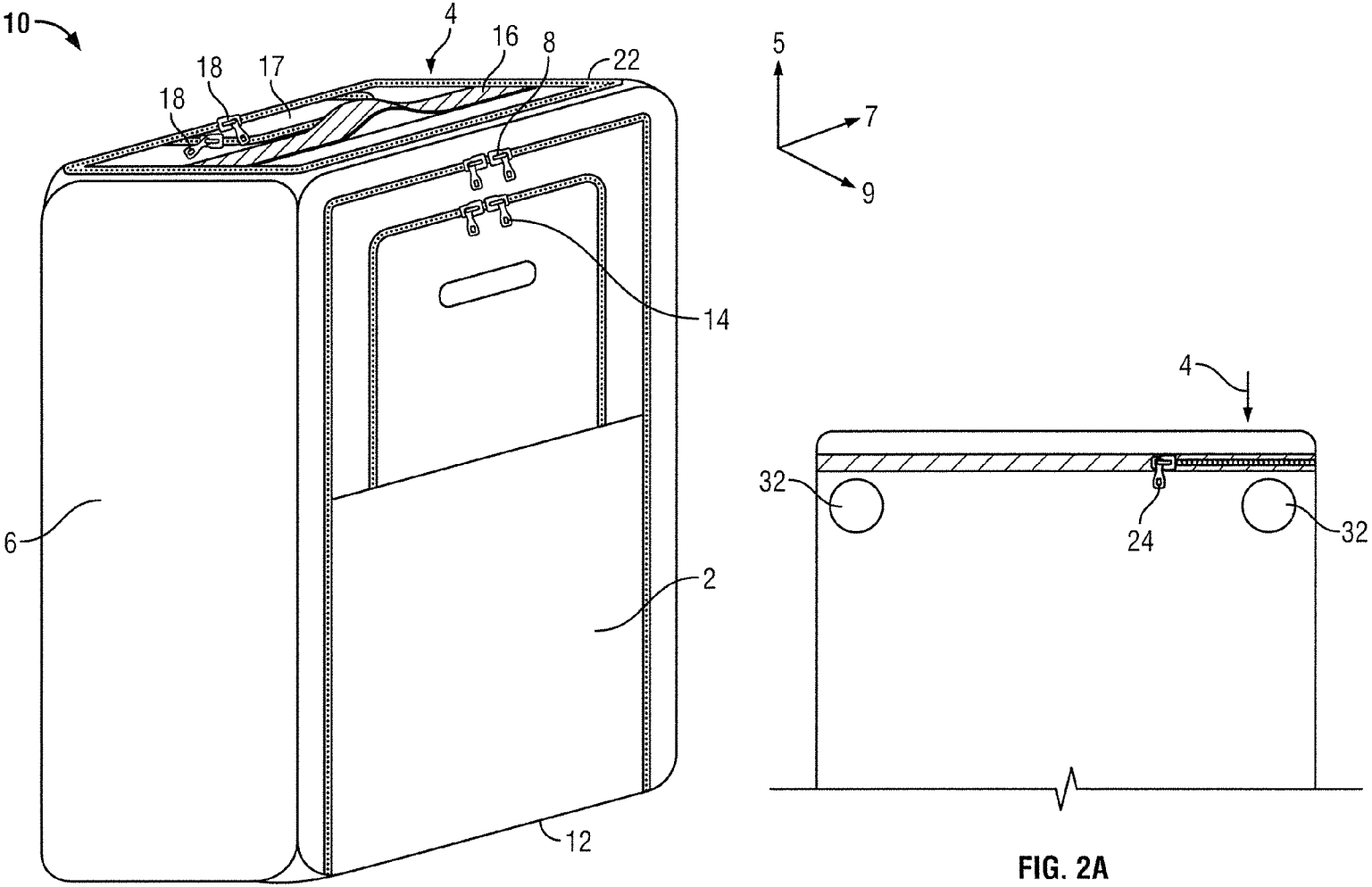

Referring to FIG. 1 there is schematic perspective view of a luggage item according to an exemplary embodiment of the present invention. Visible in FIG. 1 are the front portion, (2), top portion (4), and first side portion (6). The front portion preferably includes a closure element and in the embodiment shown includes two zips (8) enabling access to the luggage item through the front portion (2). The zips may be unzipped and the front portion (2) pivots about the axis where the front portion (2) and base (10) meet there by allowing access to the upper storage zone of the luggage item as more clearly shown in FIG. 6.

The front portion (2) and back portion (26), not visible in FIG. 1, are substantially parallel and the side portion (6) are substantially parallel. The base (10) and top portions (4) are also substantially parallel. The front portion may include a compartment accessible via zip (14). The top portion (4) may comprise a handle (16) enabling lifting of this luggage item as a whole. The top portion may further include an access portion (16) which may be opened via one or more zips (18) which enables passage therethrough of a handle arrangement (20) as more clearly shown in FIG. 3. The top portion (4) further comprises an expansion arrangement (22) which includes a closure element comprising one or more zips 24 shown in FIG. 2 which extend around the peripheral edge of the side portion (6) and the front and back portions (2, 26) where they intersect with the top portion (4). These are more clearly shown in FIG. 2. Opening of the at least one closure element enables expansion of the top (4) in an upward direction meaning that the luggage can be expanded in the longitudinal axis.

Referring to FIG. 2*a* the luggage is shown in the retracted configuration where the closure element represented by a zip (24) secures the expanding top (4) relative to the side portion (6) and front and back portions (2,26). Referring to FIG. 2*b*, as the zip is undone the top portion (4) is enabled to move in the longitudinal axis as identified by arrow (28) thereby increasing the volume of the storage zone. In the retracted configuration the extension material (30) is folded inwardly into the storage zone. The longitudinal length of the extension material (30) determines the expansion capability of the luggage item and this can be set at manufacture. A suitable expansion distance associated with the longitudinal length of the extension material (30) may be in the order of 5 cm.

As shown in FIGS. 2*a* and 2*b* one or more support elements (32) are provided on the back portion (26) to support the luggage item on a surface on which the luggage item is placed which is the usual configuration when a user wishes to access the storage zone of the luggage item.

Figure 2C:
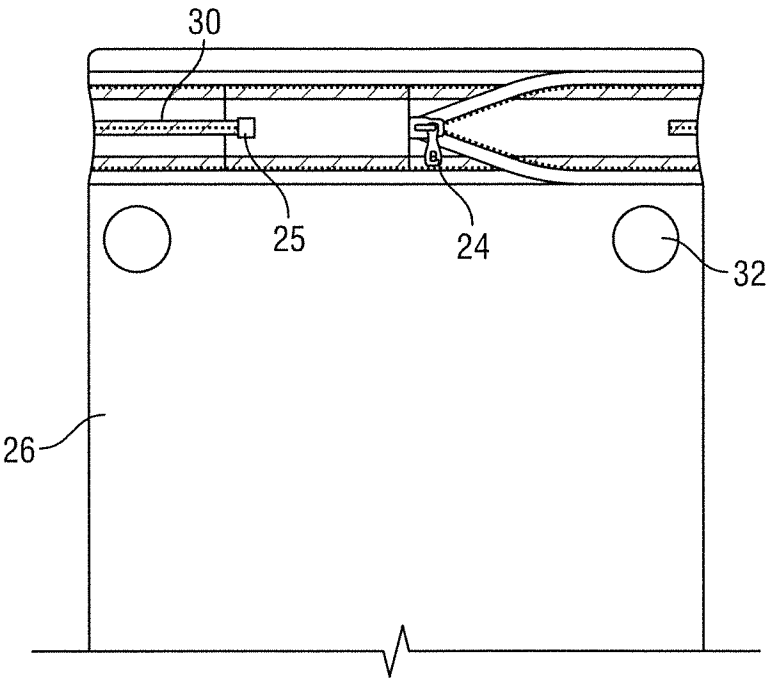
Figure 2B:
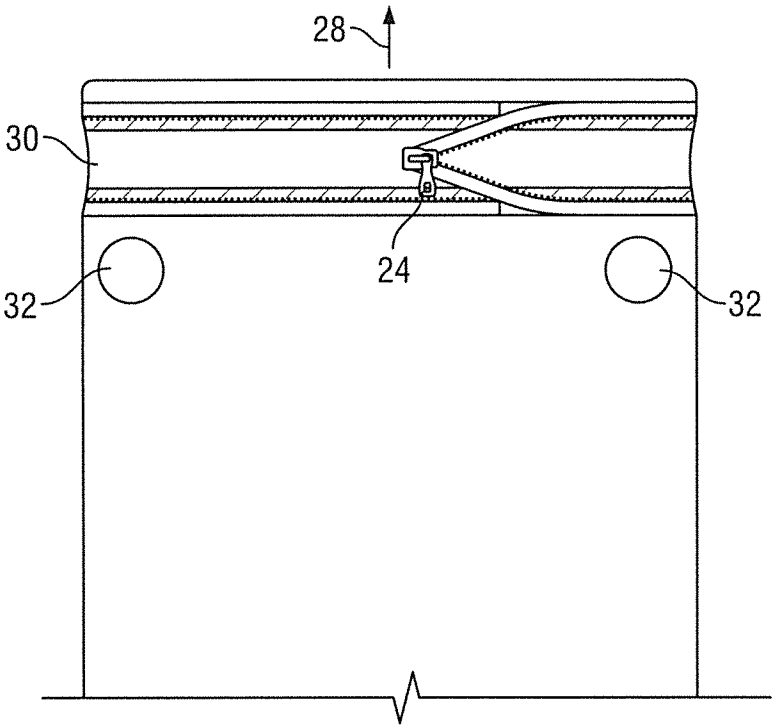
Figure 2E:
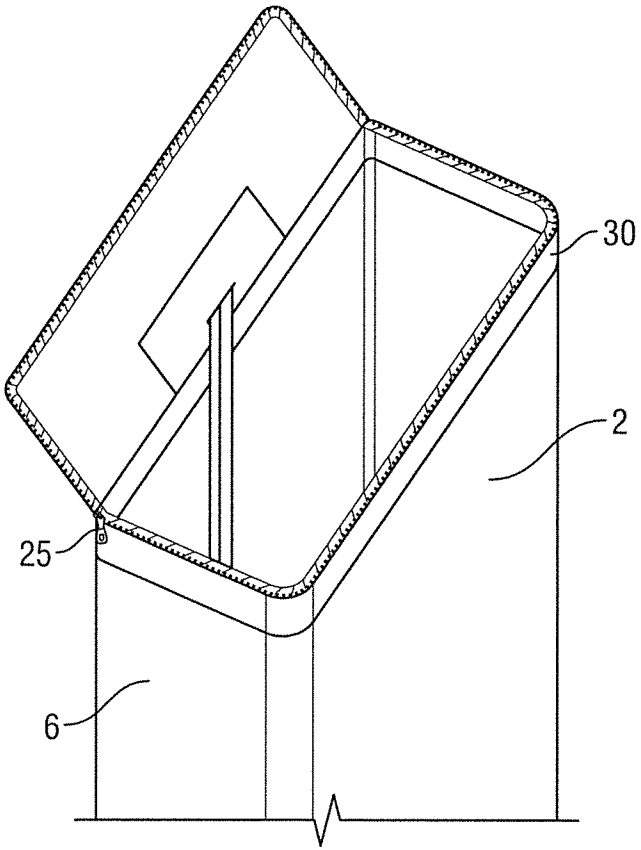
Figure 2D:
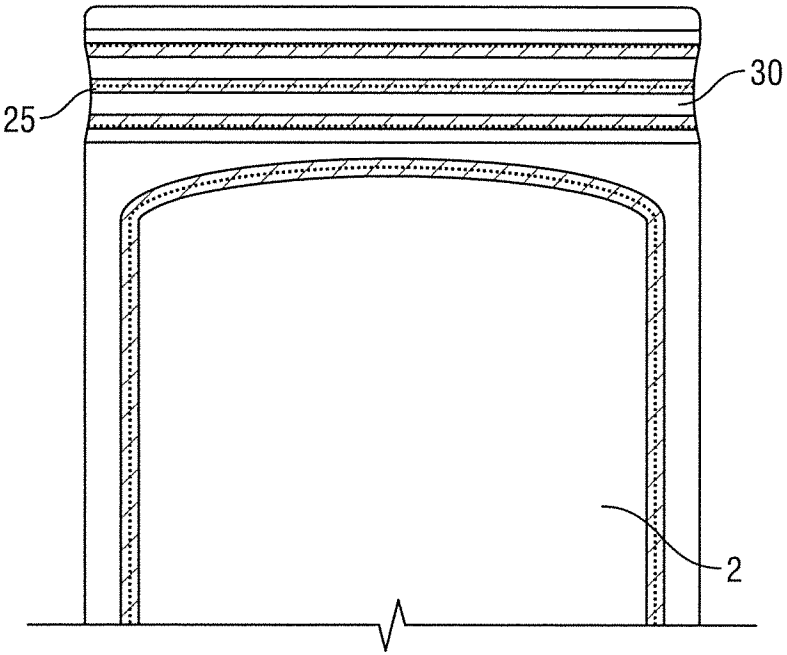

In one embodiment access may be provided to the storage zone through the top portion (4), and this is schematically represented in FIGS. 2*c, d* and *e*. There may be provided access through the top portion (4) of the luggage item. The access may be enabled through a closure element (25). The closure element may comprise a zip (25) extending across at least a portion of the top portion (4). Alternatively and as represented in the Figures, the closure element (25) is retained or enclosed in the retracted configuration by the closure element (24). It is beneficial that the closure element (25) is positioned to enable separation of the extension material (30). In the retracted configuration therefore the closure element (25) is encapsulated by the closure element (24). When opened the closure element (25) enables at least a portion of the top portion (4) to be retracted or pivoted open to allow access to the storage zone.

Figure 3:
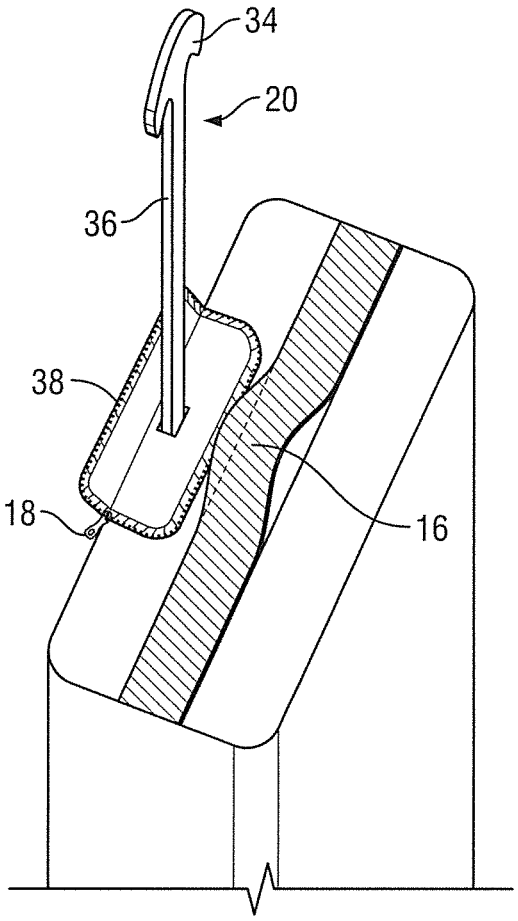
FIG. 3 is a schematic perspective view of the top portion of a luggage item according to an exemplary embodiment of the present invention.
Figure 5:
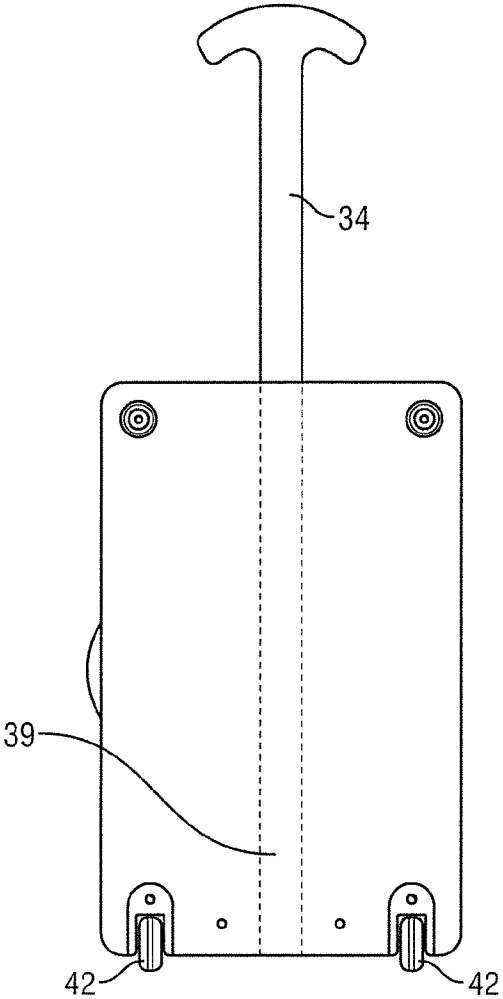
FIG. 5 is a schematic back view of a luggage item according to an exemplary embodiment of the present invention with the handle arrangement in the expanded configuration.

Referring to FIG. 3, there is presented a schematic representation of the top portion (4) showing the handle arrangement (20). The handle arrangement (20) includes a handle (34) and shaft (36). In the retracted configuration the handle arrangement is retained within the luggage item and is covered by a flap (38). The flap (38) is beneficially secured through a zip (18) reducing the possibility of the handle (34) being snagged or unintentionally caught on another item during transit. The flap (38) is opened to enable access to the handle arrangement which can be withdrawn from the luggage item. The handle arrangement (20) and the shaft (36) in particular are retained in a channel (40) best represented in FIG. 5 adjacent and internally of the back portion (26). FIG. 3 also shows a handle (16) enabling ease of carrying the luggage item as required.

Figure 4:
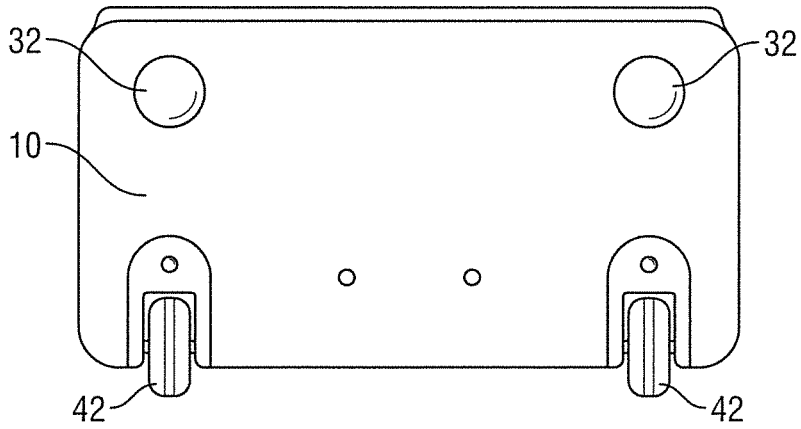
FIG. 4 is the schematic view of the base of a luggage item according to an exemplary embodiment of the present invention.

Referring to FIG. 4 there is a schematic representation of the base according to an exemplary embodiment of the present invention. Wheels (42) are beneficially provided enabling ease of transportation of the luggage item across a surface, beneficially via pulling on the handle (34). The base also includes one or more support elements (32) for providing support and protection to the base portion (10).

Figure 6:
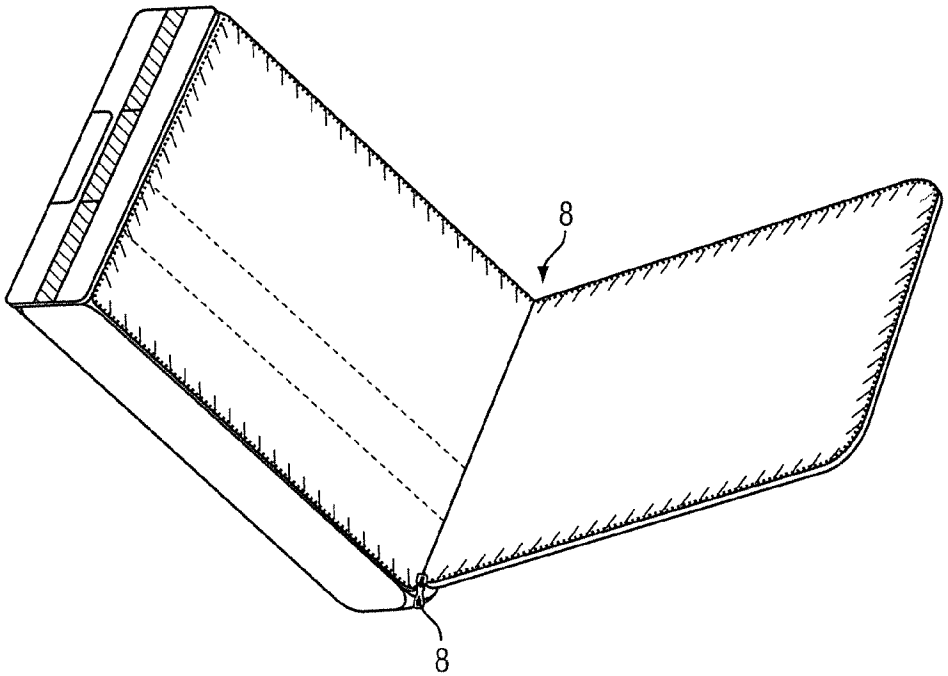
FIG. 6 is a schematic perspective view of a luggage item according to an exemplary embodiment of the present invention in the open configuration enabling access to the storage zone.

Referring to FIG. 6 the luggage item is in the open configuration whereby the zip (8) has been opened allowing access to the storage zone. Opening of the front portion (2) in this manner ensures maximum capability of access to the storage zone. The front portion (2), which effectively forms a lid, can be pivoted open and closed around the axis of the intersection between the front portion (2) and the base (10).

Figure 7:
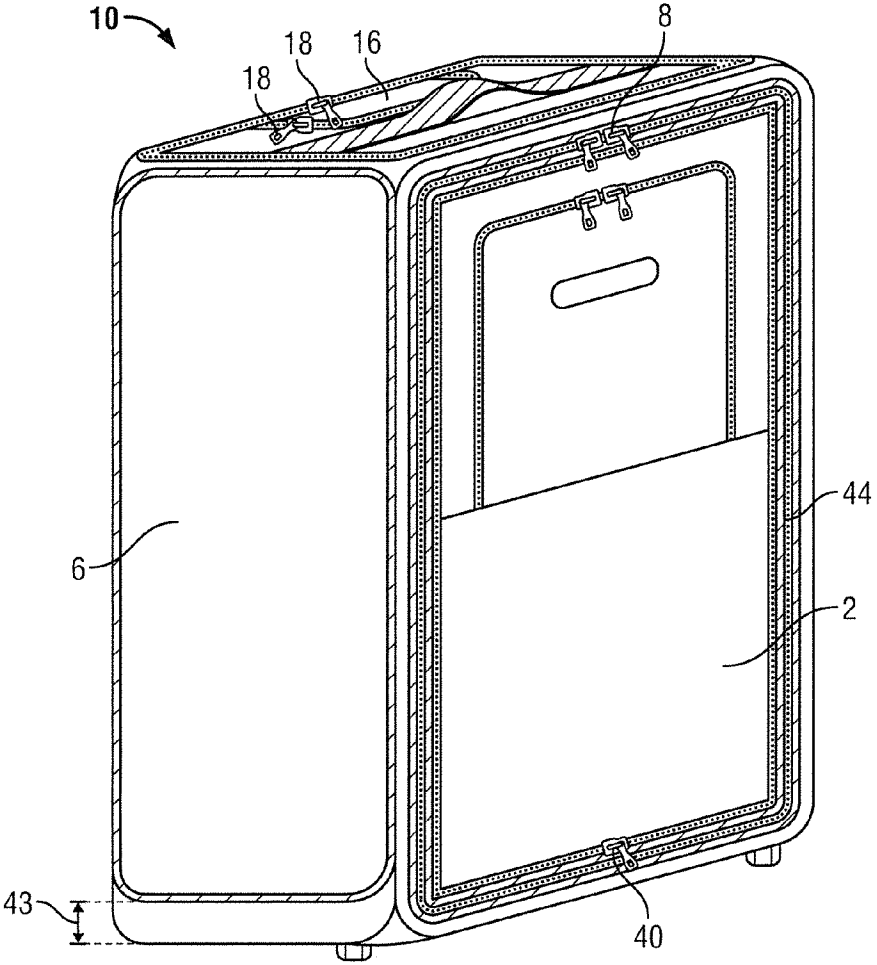
FIG. 7 is a schematic perspective view of a luggage item according to an exemplary embodiment of the present invention showing first, second and third expansion arrangements.

Referring to FIG. 7 there is a schematic perspective view of a luggage item according to an exemplary embodiment of the present invention. The luggage item as identified in FIG. 7 is arranged to extend or be expandable in three different axes. The axes are perpendicular to each other. The luggage item is expandable vertically, and is also expandable in terms of width, and is also expandable in terms of depth. It will be appreciated, however, that the luggage item may expand in two axes, thus may expand vertically and in respect to the width, or vertically and in respect of the depth.

Vertical extension or expansion in the longitudinal axis is the same in this embodiment as described with respect to the embodiment shown in FIG. 1. Furthermore, the luggage item may be opened via upper zips (8) in the same manner as shown in FIG. 1 meaning that the front portion (2) in the open configuration effectively hinges about the intersection between the front portion (2) and the base portion (10). As best shown in FIGS. 8*a* and 8*b* the luggage item as identified in FIG. 7 comprises an expansion arrangement generally represented by numeral (44) enables expansion of the luggage item to increase the depth. A portion therefore of the front portion (2) is provided which expands or moves relative to the luggage item. The expansion arrangement (44) in the embodiment shown includes a zip (40) which as shown in FIG. 7 is shown in the contracted configuration whereby the zip (40) is done up preventing the expansion of the front portion (2). When this zip (40) is undone to the configuration as shown in FIGS. 8*a* and 8*b* then the depth of the luggage item is increased. It is beneficial that the expansion arrangement (44) is provided inwardly of the zip (8) which is used to enable access to the storage zone. This is beneficial as in both the retracted and expanded configuration access to the storage zone is unimpeded. Accordingly the expansion arrangement (44) can be expanded irrespective of whether access to the storage zone is prevented or allowed.

The expansion arrangement (44) as presented in the exemplary embodiments is provided by a flexible material between opposing first and second sides of the zip (40) which folds in the retracted configuration and extends in the expanded configuration. In the expanded configuration the first and second parts (40*a*, 40*b*) of the zip are spaced apart.

It is further beneficial that the side portion (6) expands to further increase the volume of the storage zone within the luggage item. This further improves the flexibility of the luggage item to accommodate the different sizes of luggage items. Referring particularly to FIGS. 7 and 9 it will be appreciated that the expansion arrangement enables expansion of the side however there is an offset meaning that there is no expansion of the side portion at or adjacent the base portion (10). This offset is better represented by reference numeral 42 and prevents the expansion arrangement (46), which may include a zip retaining a flexible expansion portion, from contacting the floor. This prevents damage to the expansion arrangement.

The present invention has been described by way of example only and it will be appreciated by the skilled addressee that modifications and variations may be made without departing from the scope of protection afforded by the appended claims.

The invention claimed is:

1. A luggage item comprising:

a luggage body having a top, a base, a front, a back and an opposing first and second side portion, wherein the luggage body has a storage zone defined between the top, the base, the front, the back and the opposing first and second side portion;

the top having a first expansion arrangement with a first extension section that is expandable between a retracted and an expanded position along a longitudinal first axis, the first expansion arrangement further having a first closure element for maintaining the first extension section in the retracted position;

at least one of the first or second side portions having a second expansion arrangement with a second extension section that is expandable between a retracted and an expanded position along a second axis, the second axis being perpendicular to the first axis, the second expansion arrangement further having a second closure element for maintaining the second extension section in the retracted position, the second extension section being spaced apart along the longitudinal axis from the base portion; and the front having a third expansion arrangement with a third extension section that is expandable between a retracted and an expanded position along a third axis, the third axis being perpendicular to the first and second axes, the third expansion arrangement further having a third closure element for maintaining the third extension section in the retracted position;

wherein the first, second and third extension sections independently expand the storage zone and the base portion has a fixed cross sectional area irrespective of the shape of the storage zone.

2. A luggage item according to claim 1, wherein the top portion comprises an access portion that is retractable to enable access to the storage zone.

3. A luggage item according to claim 2, wherein a closure element is provided to retain the access portion in a closed configuration.

4. A luggage item according to claim 1, wherein the first extension section has front, back and side portions, and the closure element is a zip extending around at least part of the front, back or side portions.

5. A luggage item according to claim 1, wherein the front portion is arranged to enable access to the storage zone.

6. A luggage item according to claim 1, further comprising a handle arrangement including a handle and a shaft, the shaft being secured to the back portion, wherein the shaft is extendable along the first axis.

7. A luggage item according to claim 6, wherein the shaft extends through an opening provided in the top portion.

8. A luggage item according to claim 1, wherein the front and back portions are substantially parallel, and the opposing first and second side portions are substantially parallel.

9. A luggage item according to claim 1, further comprising one or more wheels positioned to enable movement of the item of luggage across a surface.

10. A luggage item according to claim 1, wherein the first, second and third extension sections extend linearly between expanded and retracted positions.

* * * * *